US012679624B2

(12) United States Patent
Ghiz

(10) Patent No.: US 12,679,624 B2
(45) Date of Patent: Jul. 14, 2026

(54) EQUIPMENT CASE PROTECTIVE LAYER SYSTEMS AND METHODS

(71) Applicant: Pelican Products, Inc., Torrance, CA (US)

(72) Inventor: Christopher Ghiz, South Deerfield, MA (US)

(73) Assignee: Pelican Products, Inc., Torrance, CA (US)

( * ) Notice: Subject to any disclaimer, the term of this patent is extended or adjusted under 35 U.S.C. 154(b) by 5 days.

(21) Appl. No.: 18/644,081

(22) Filed: Apr. 23, 2024

(65) Prior Publication Data

US 2025/0326558 A1 Oct. 23, 2025

(51) Int. Cl.

*B65D 81/113* (2006.01)
*B65D 81/133* (2006.01)
*B65D 85/68* (2006.01)

(52) U.S. Cl.

CPC ..... *B65D 81/113* (2013.01); *B65D 81/133* (2013.01); *B65D 85/68* (2013.01); *B65D 2581/05* (2013.01); *B65D 2585/6837* (2013.01)

(58) Field of Classification Search

CPC .... B65D 81/113; B65D 81/133; B65D 85/00; B65D 85/30; B65D 85/57; B65D 85/68; B65D 2581/05; B65D 2585/6857

USPC ..... 206/320, 523

See application file for complete search history.

(56) References Cited

U.S. PATENT DOCUMENTS 3,777,882 A 12/1973 Mcintyre
4,240,240 A 12/1980 Cohen
4,522,303 A 6/1985 Starr
5,002,184 A 3/1991 Lloyd
5,553,444 A 9/1996 Lovecky et al.
5,738,216 A 4/1998 Warner
5,794,773 A * 8/1998 Moyer ..... A63B 47/007 206/315.91
5,816,395 A * 10/1998 Dougherty ..... A45C 5/02 206/523
6,179,122 B1 * 1/2001 Moncrief ..... G06F 1/1628 206/320
6,334,534 B1 1/2002 Hollingsworth et al.
6,415,922 B1 7/2002 Lee
(Continued)

OTHER PUBLICATIONS

Extended European Search Report dated Oct. 1, 2025, for corresponding European Application No. 25166694.7; 12 pages.

*Primary Examiner* — Bryon P Gehman

(74) *Attorney, Agent, or Firm* — Nelson Mullins Riley & Scarborough LLP

(57) ABSTRACT

An equipment case has a lid and a base that are connectable to define an interior volume and a foam stack disposed within the interior volume. The foam stack includes a first layer of foam coupled with the base and that defines a first opening sized to receive a first computing device. The foam stack also includes a tray that is removably disposed above the first layer. A bottom wall of the tray defines a second opening sized to receive a second computing device. The tray includes a plurality of side walls that, together with the bottom wall, define a third opening sized to receive a third computing device. The foam stack also includes a third layer of foam coupled with an interior surface of the lid and including a removable portion sized to fit within the plurality of side walls in the tray.

17 Claims, 13 Drawing Sheets

(56) References Cited

U.S. PATENT DOCUMENTS

| | | | | |
|---|---|---|---|---|
| 6,896,134 | B2 * | 5/2005 | Russell | G06F 1/1628 206/320 |
| 6,981,589 | B2 | 1/2006 | Sanders, Jr. | |
| 7,114,618 | B2 | 10/2006 | Arnold | |
| 7,293,647 | B2 * | 11/2007 | Wong | B65D 25/10 206/308.1 |
| 7,306,102 | B2 | 12/2007 | Chang | |
| 7,475,816 | B1 * | 1/2009 | Rochelo | A45C 11/18 206/308.1 |
| 7,500,561 | B2 | 3/2009 | Matias et al. | |
| 8,061,522 | B2 | 11/2011 | Eskenazi et al. | |
| 9,169,059 | B2 * | 10/2015 | Shen | B65D 85/38 |
| 9,463,915 | B2 | 10/2016 | McDonald et al. | |
| 2004/0163912 | A1 | 8/2004 | Hollingsworth et al. | |
| 2006/0207914 | A1 | 9/2006 | Cance et al. | |
| 2008/0000803 | A1 | 1/2008 | Tseng et al. | |
| 2008/0017545 | A1 | 1/2008 | Miller et al. | |
| 2015/0101947 | A1 | 4/2015 | Shen | |
| 2016/0183651 | A1 | 6/2016 | Tonelli | |
| 2017/0001784 | A1 | 1/2017 | Jones | |
| 2021/0356233 | A1 | 11/2021 | Holbrook | |
| 2022/0258947 | A1 | 8/2022 | Ramirez | |

* cited by examiner

EQUIPMENT CASE PROTECTIVE LAYER SYSTEMS AND METHODS

TECHNICAL FIELD

Embodiments of the present invention relate to hard-sided equipment cases and, more particularly, certain embodiments relate to a system of protective layers for supporting multiple sizes of specific equipment, such as but not limited to computer servers, in a hard-sided case.

BACKGROUND

Hard-sided cases for storing and/or transporting various types of equipment (e.g., cameras, guns, etc.) are well-known. The Protector line of cases from Pelican Products, Inc., of Torrance, California is one example of this type of case.

It is also known to include one or more sheets of foam padding in such cases for protecting the equipment contained therein. In some cases, the foam padding can be customized by the user to organize a case interior into separate compartments and to define equipment-specific recesses in the foam padding. For example, it is known to provide a case with a sheet of convoluted foam disposed in the lid, a sheet of flat foam disposed in the base of the case body, and two or more intermediate sheets of customizable foam disposed above the base foam in the body. The customizable sheets can be pre-scored into, e.g., 0.5"×0.5"×0.5" cubes. The cubes are removable to form a recess in a desired shape to receive the equipment to be carried in the case.

SUMMARY

In accordance with one embodiment, the present invention provides an equipment case. The equipment case comprises a lid pivotably connected with a base and a plurality of protective layers disposed within the equipment case. The plurality of protective layers comprises a first protective layer and a second protective layer. The first protective layer comprises a bottom wall and a plurality of side walls. The bottom wall and plurality of side walls define a first interior volume. The first protective layer is disposed at least partially within the base. The second protective layer is coupled with an interior surface of the lid. The second protective layer comprises at least one removable portion. The removable portion is dimensioned to fit within the first interior volume. When the removable portion is disposed within the first interior volume, the removable portion and the plurality of side walls together define a second interior volume that is smaller than the first interior volume. The first interior volume is dimensioned to receive a first computing device having a first size, and the second interior volume is dimensioned to receive a second computing device having a second size smaller than the first size.

In accordance with another embodiment, the present invention provides a method of using an equipment case. The method comprises providing an equipment case comprising a lid pivotably connected with a base and a first protective layer within the base. The first protective layer comprises a bottom wall and a plurality of side walls. The bottom wall and plurality of side walls define a first interior volume corresponding to the size of a first server. The equipment case also comprises a second protective layer coupled with an interior surface of the lid. The second protective layer defines a recess in which at least one removable portion is disposed. The method also comprises removing the at least one removable portion and placing it within the first interior volume such that the removable portion and plurality of side walls define a second interior volume corresponding to the size of a second server. Further, the method comprises placing the second server in the second interior volume and moving the lid from an open position to a closed position relative to the base.

In accordance with a further embodiment, the present invention provides an equipment case. The equipment case comprises a lid and a base, wherein the lid and base are connectable to one another to define an interior volume. The equipment case also comprises a foam stack disposed within the interior volume. The foam stack comprises a first layer of foam coupled with the base. The first layer of foam defines a first opening sized to receive a first computing device. The foam stack also comprises a tray that is removably disposed above the first layer. A bottom wall of the tray defines a second opening sized to receive a second computing device. The tray comprises a plurality of side walls that, together with the bottom wall, define a third opening sized to receive a third computing device. The foam stack also comprises a third layer of foam coupled with an interior surface of the lid. The third layer of foam comprises a removable portion sized to fit within the plurality of side walls in the tray.

BRIEF DESCRIPTION OF THE DRAWINGS

Figure 1:
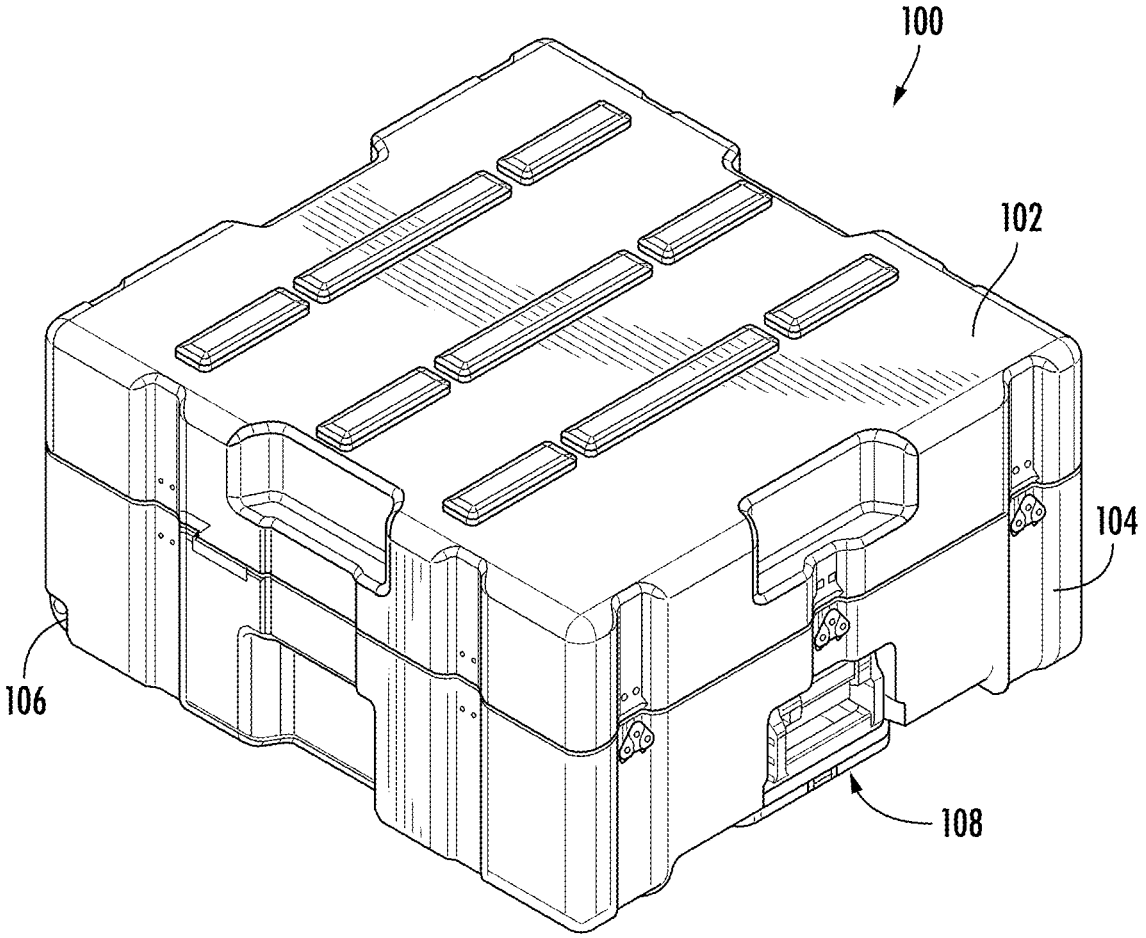
Figure 2:
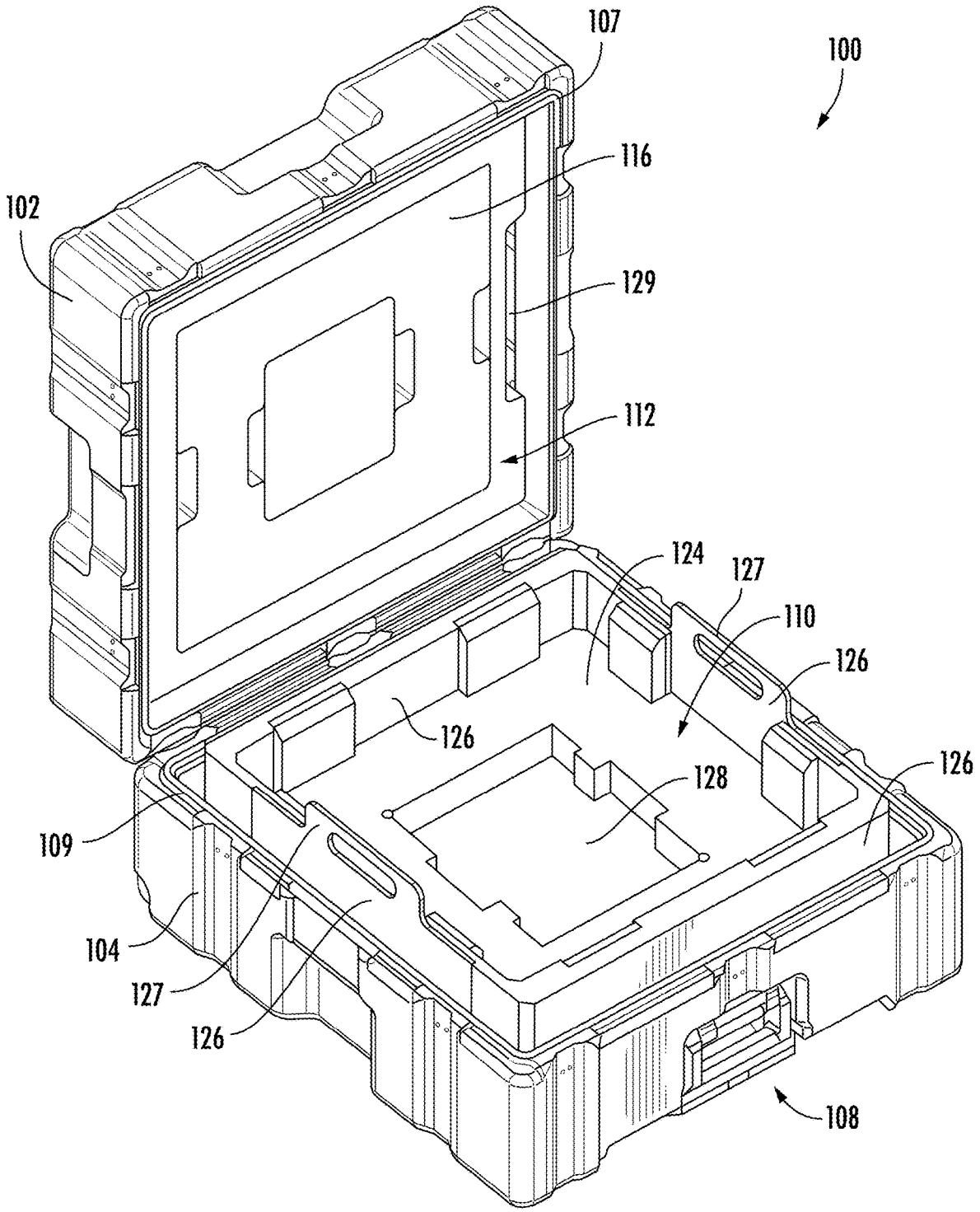
Figure 3:
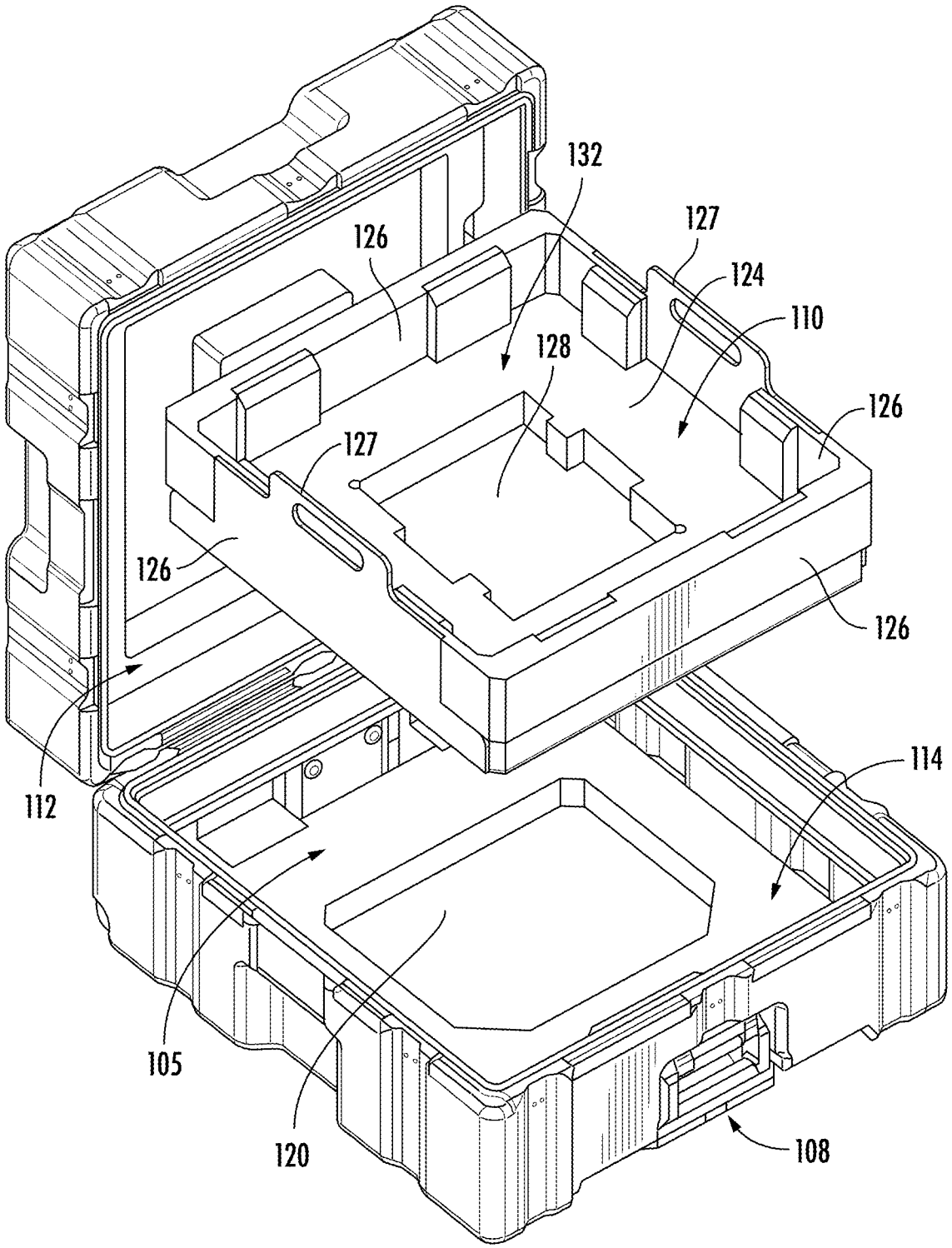
Figure 4:
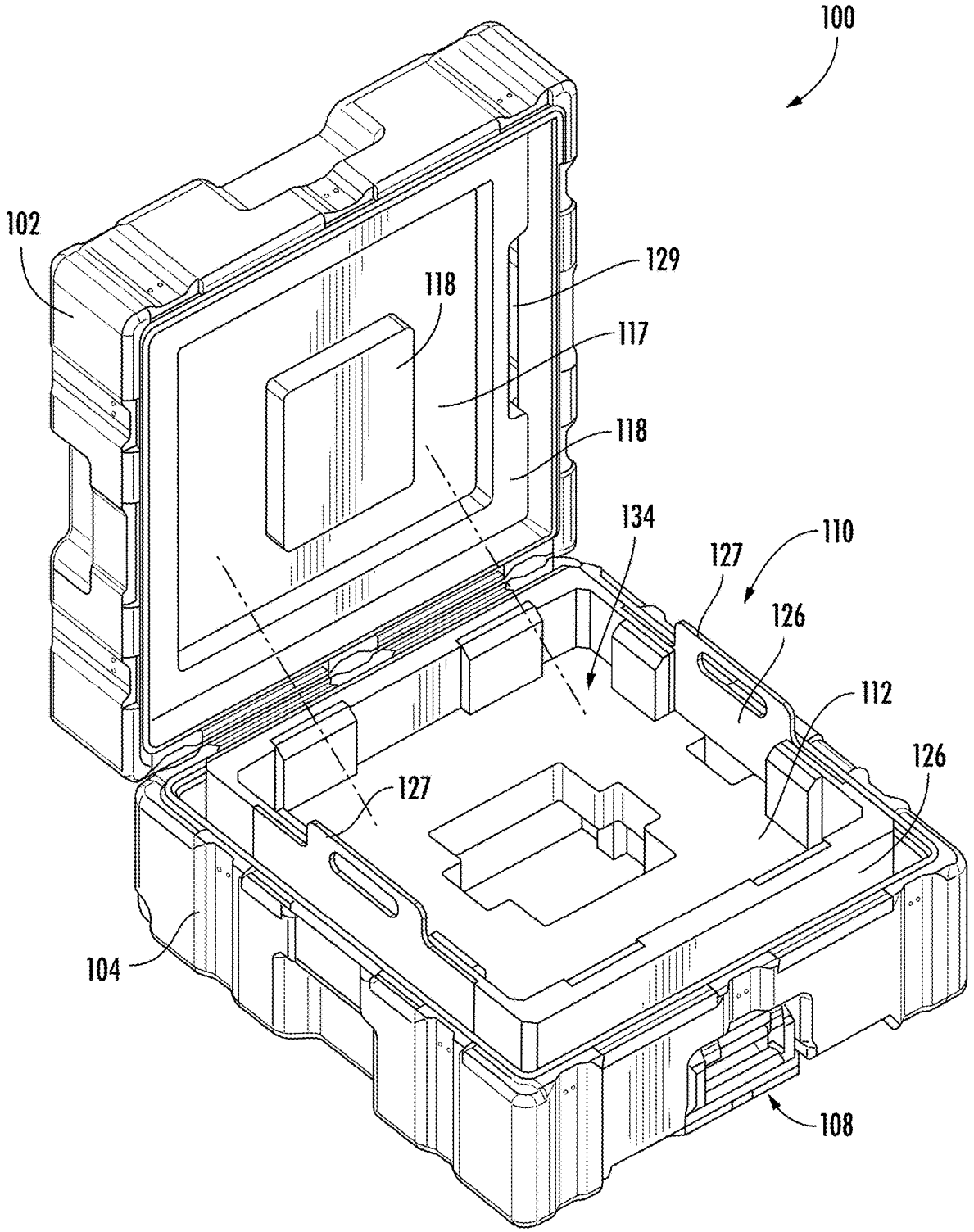
Figure 5:
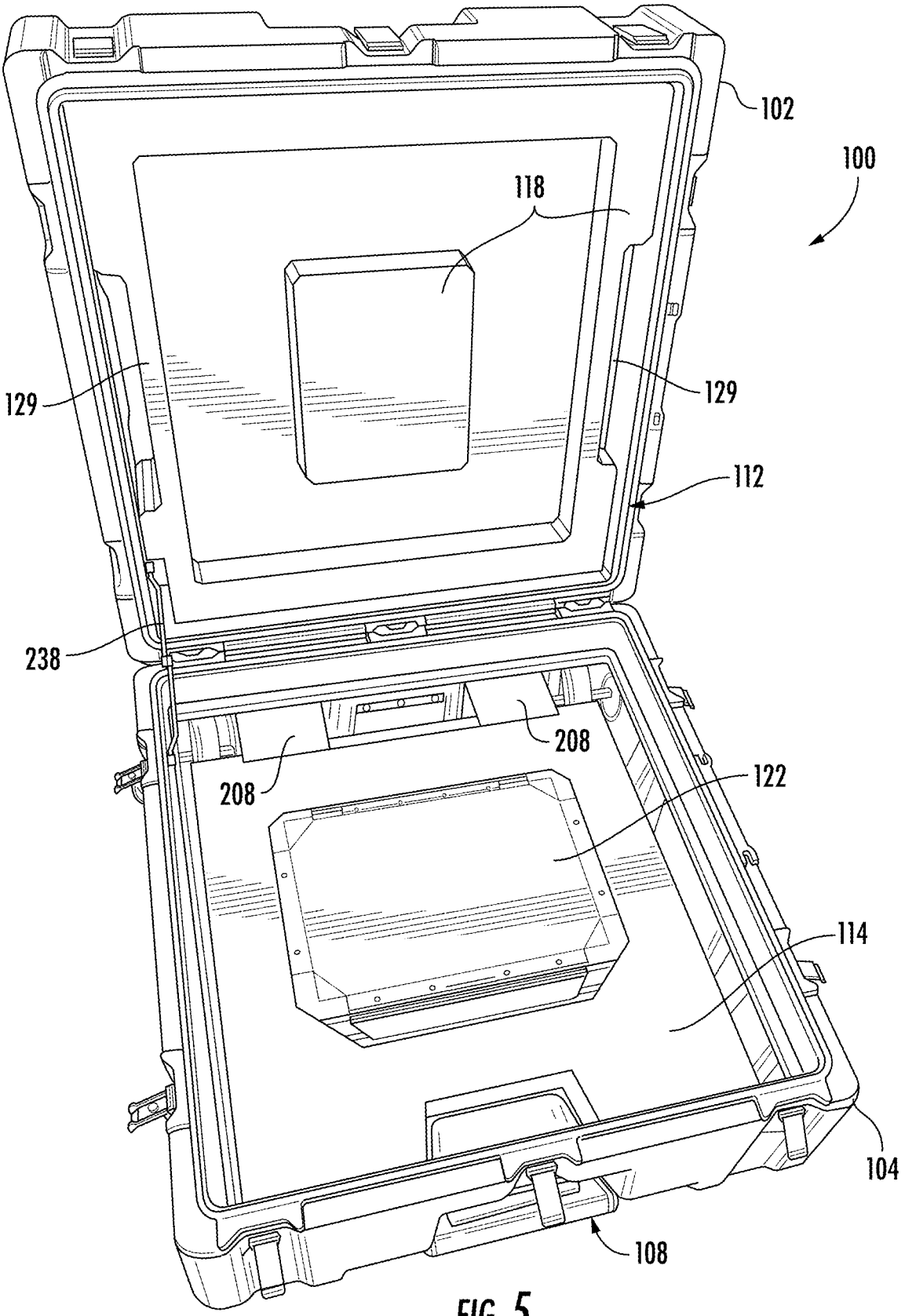
Figure 6:
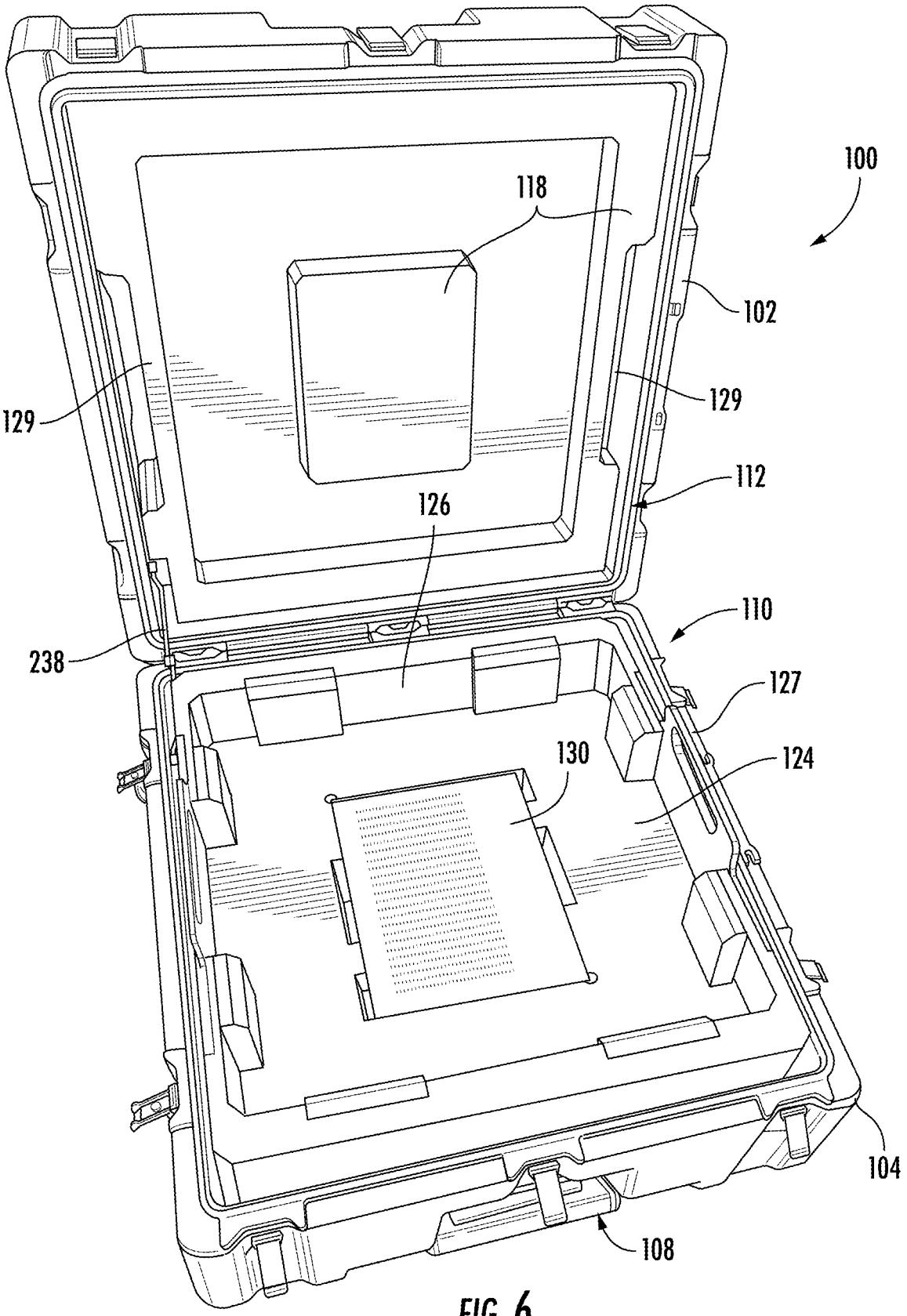
Figure 7:
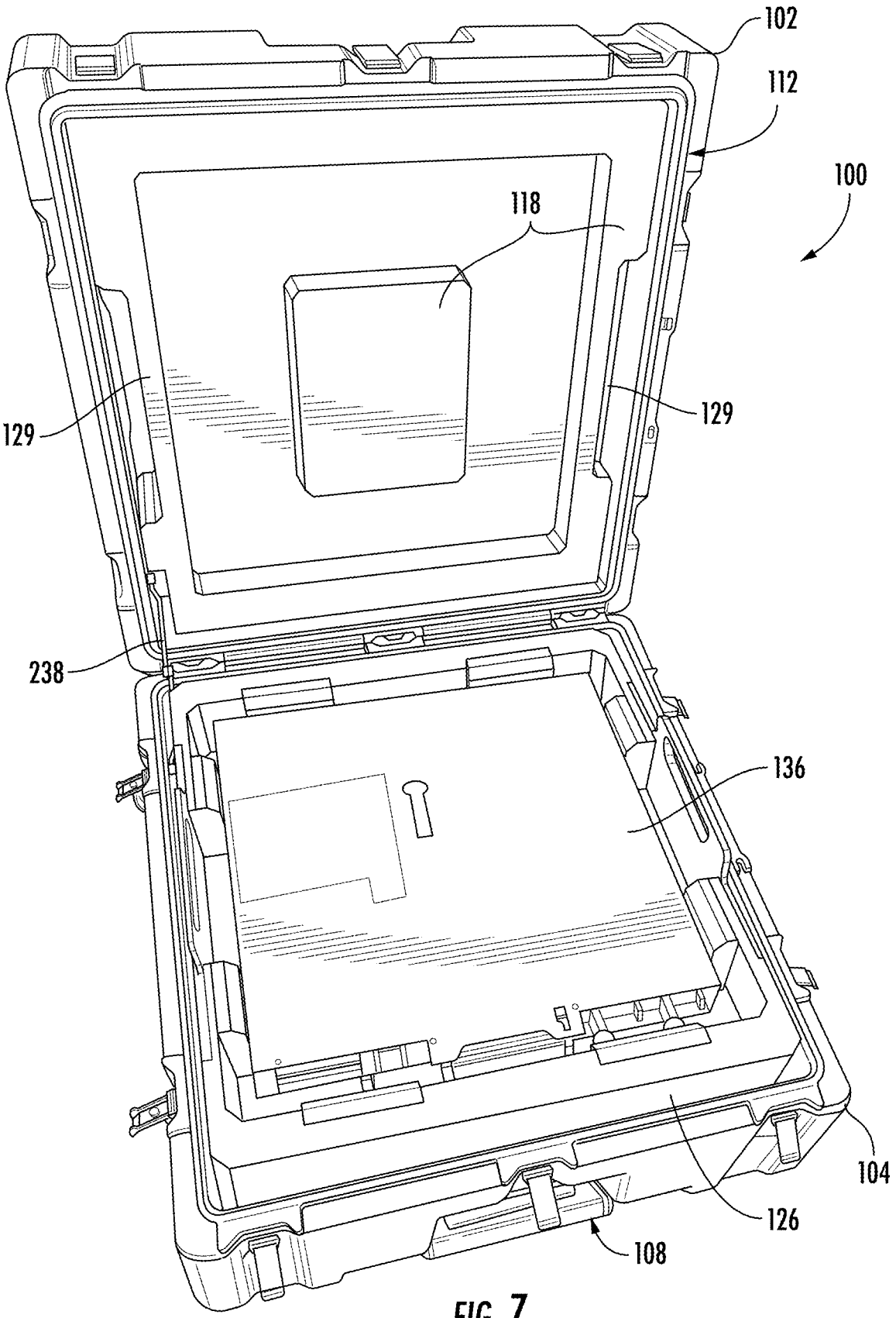
Figure 8A:
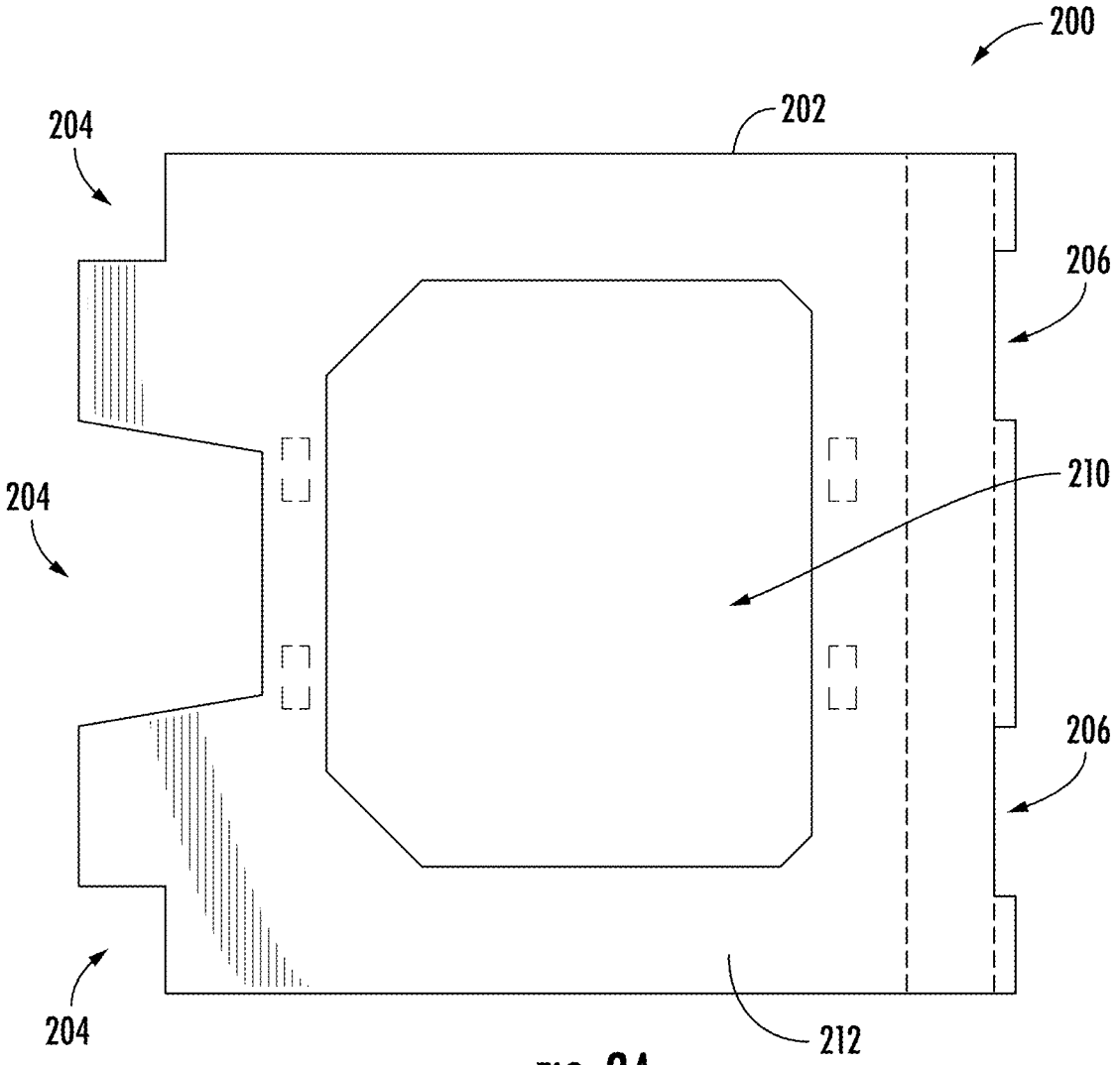
Figure 8B:
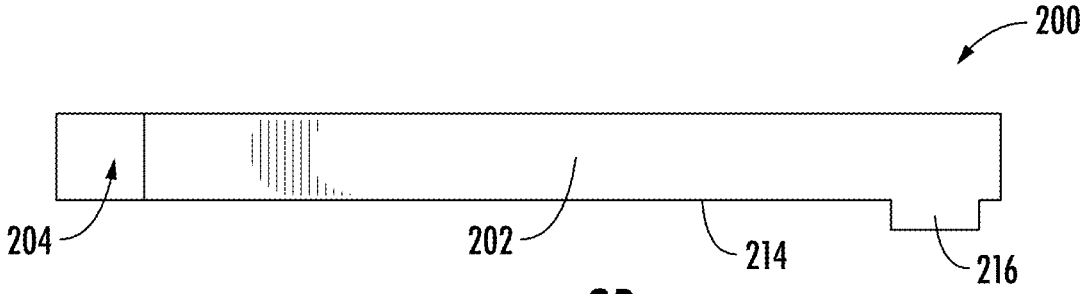
Figure 9A:
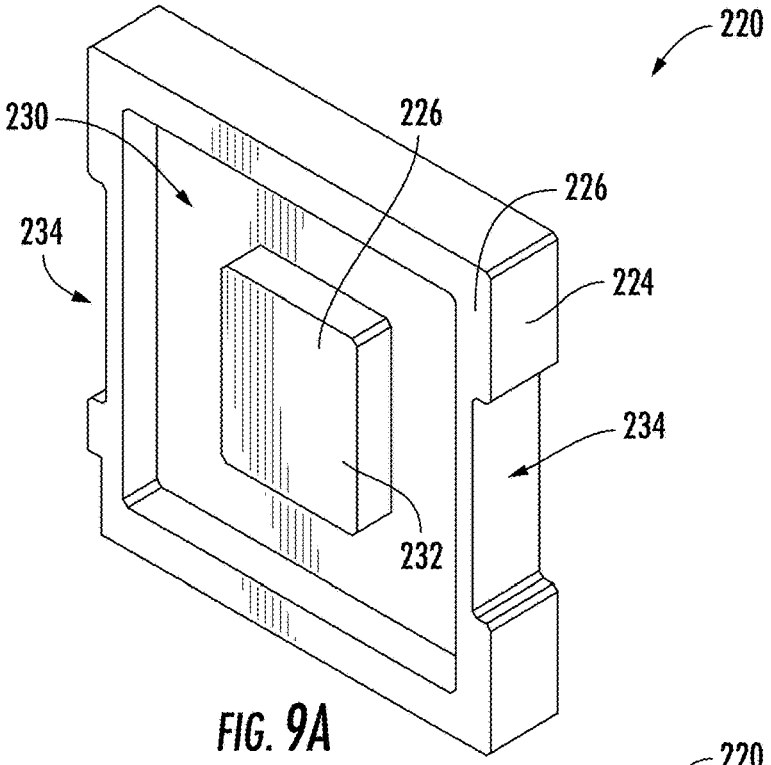
Figure 9B:
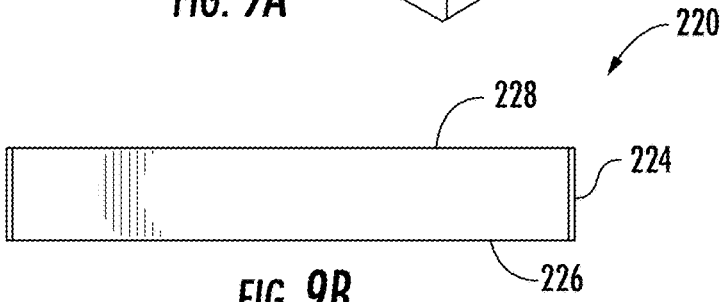
Figure 9C:
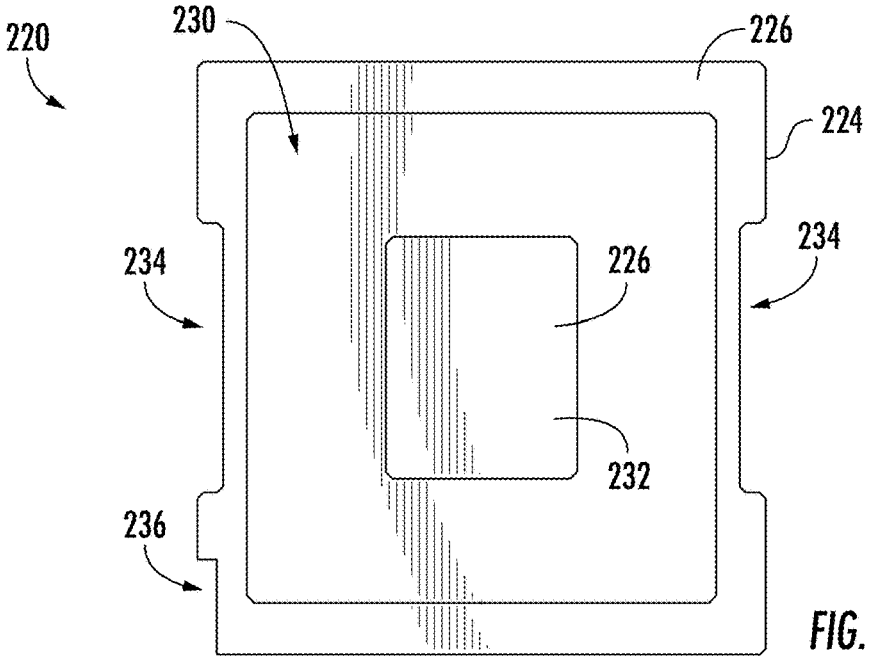
Figure 10A:
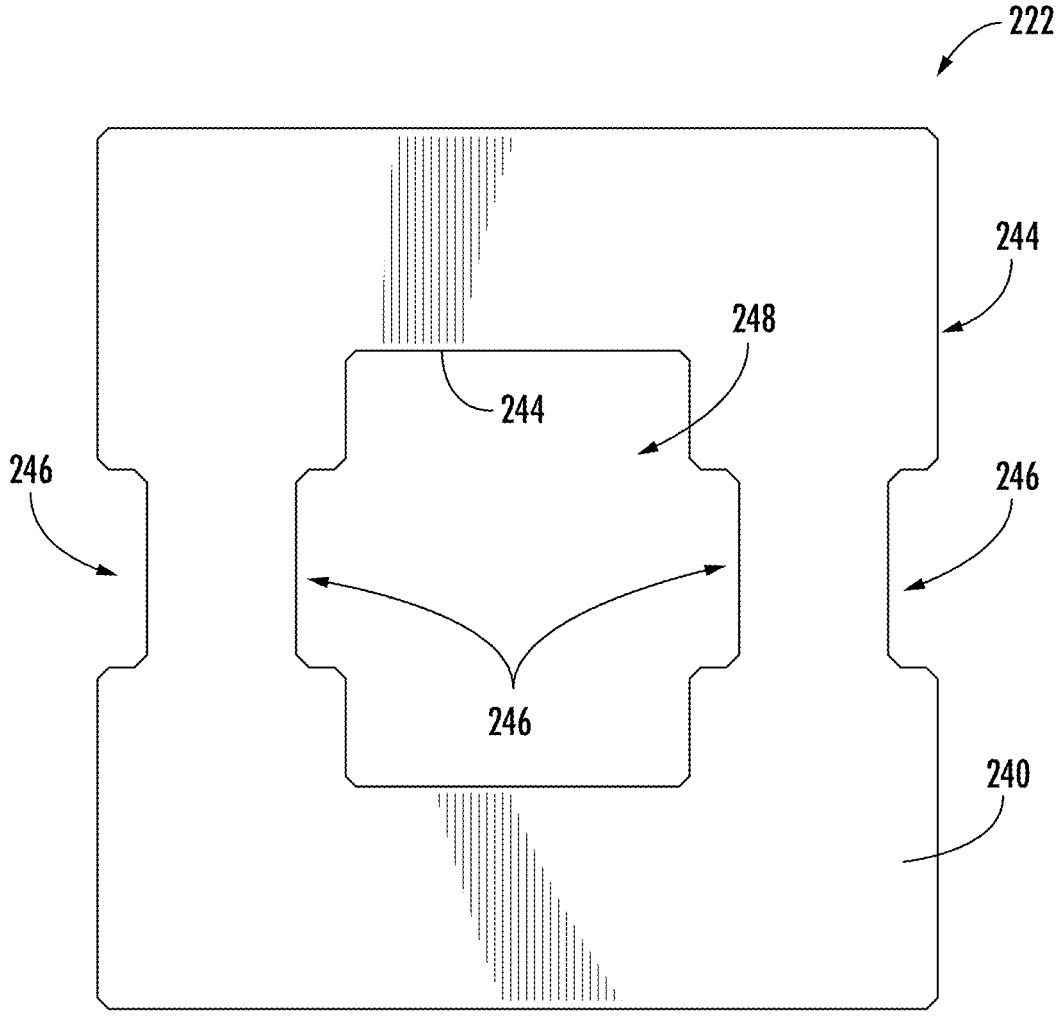
Figure 10B:
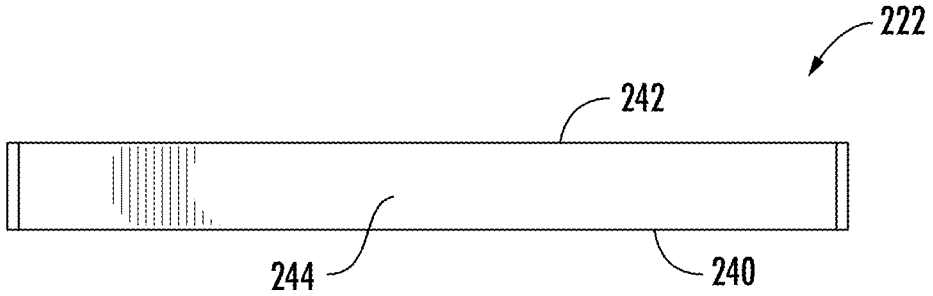
Figure 11:
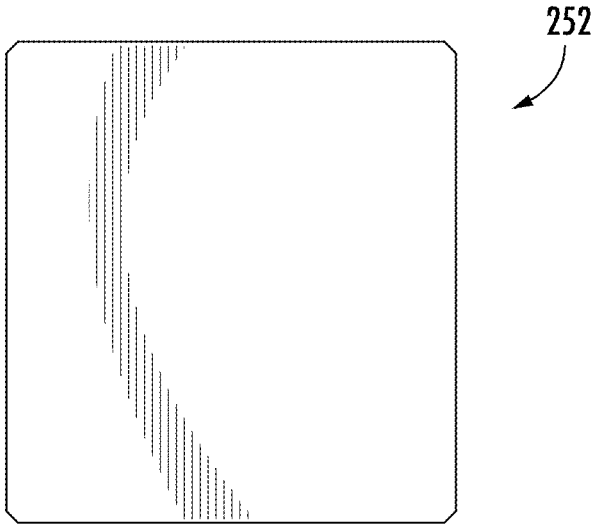
Figure 12:
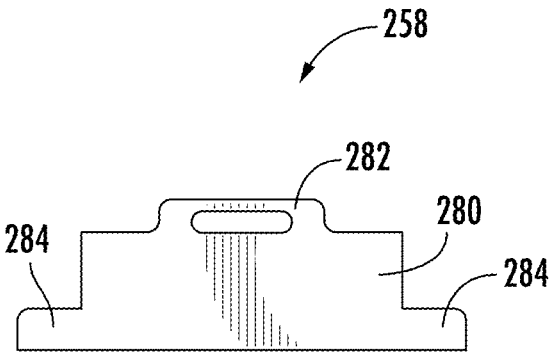
Figure 13A:
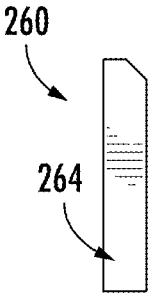
Figure 13B:
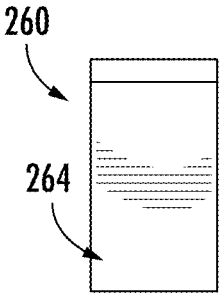
Figure 14A:
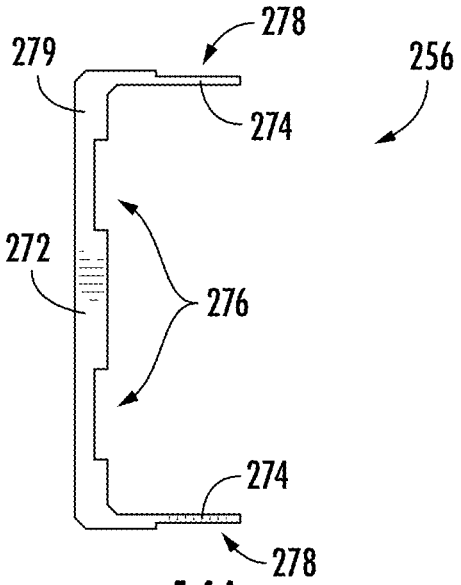
Figure 14B:
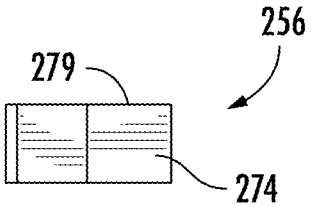
Figure 15A:
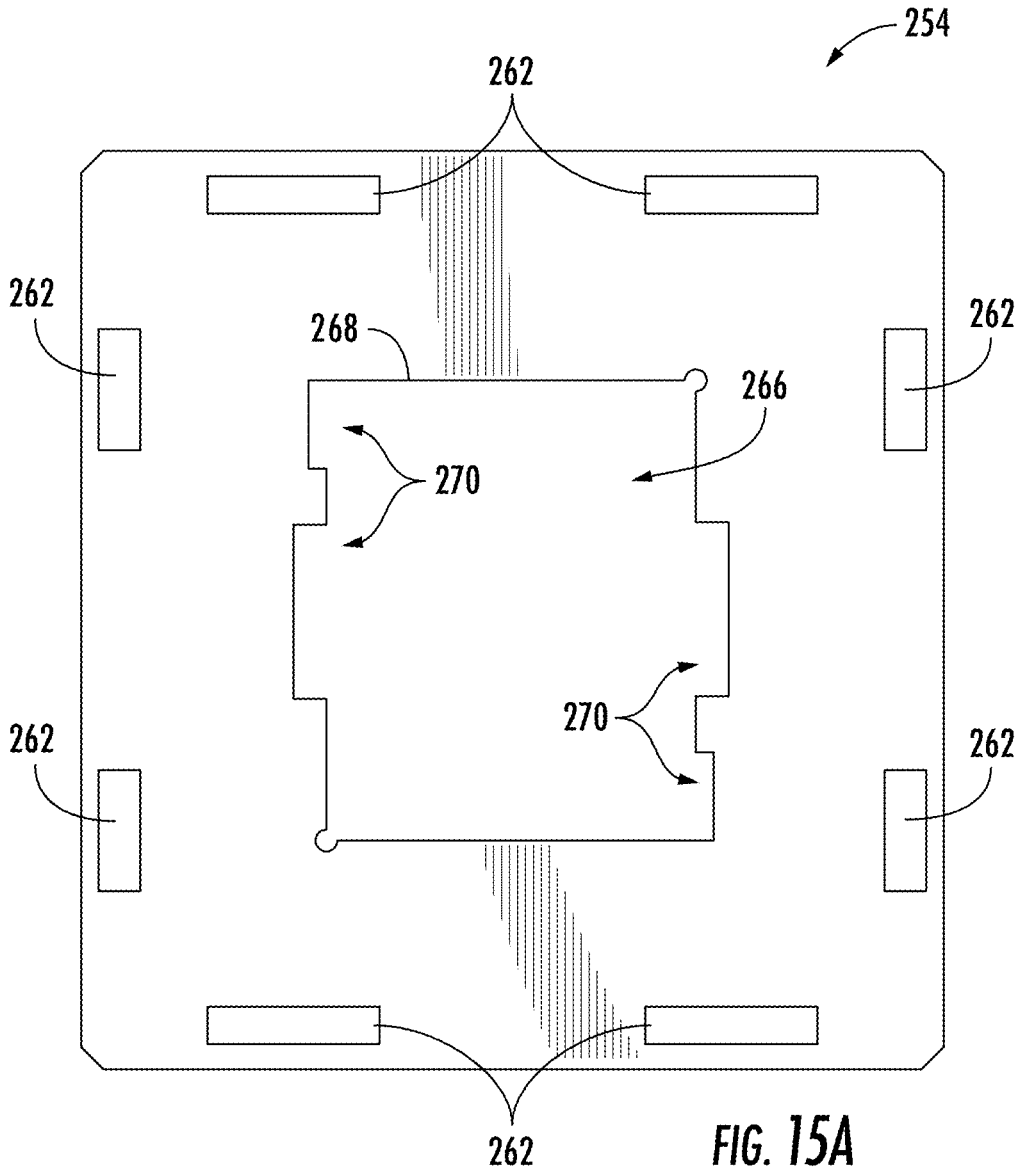
Figure 15B:
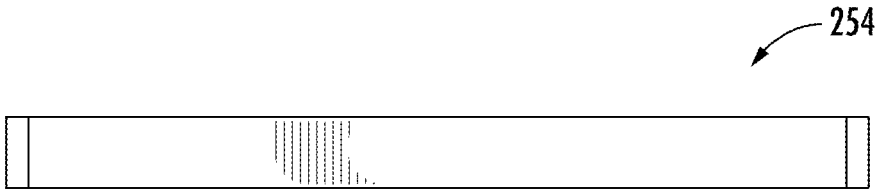
Figure 16B:
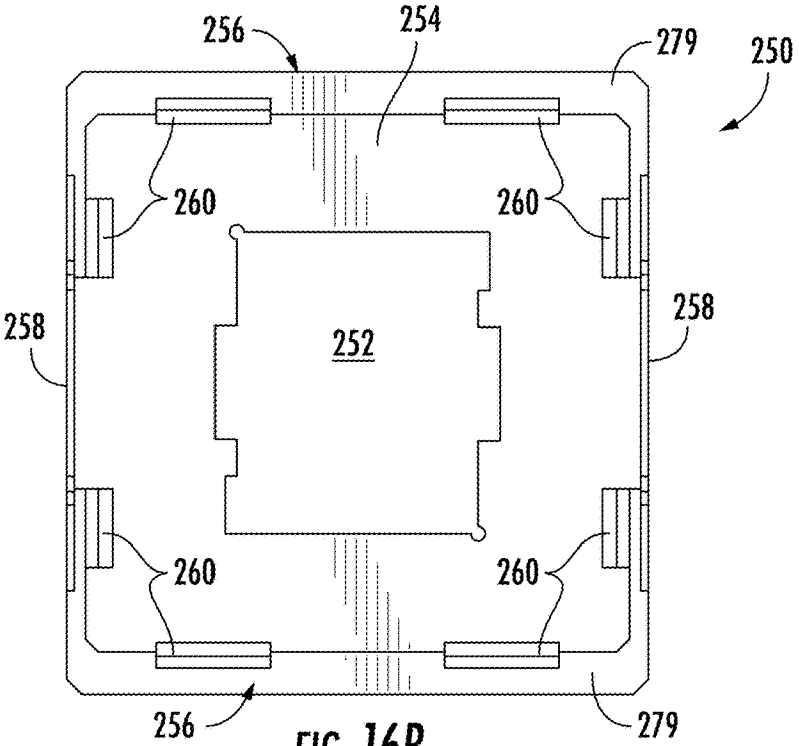
Figure 16C:
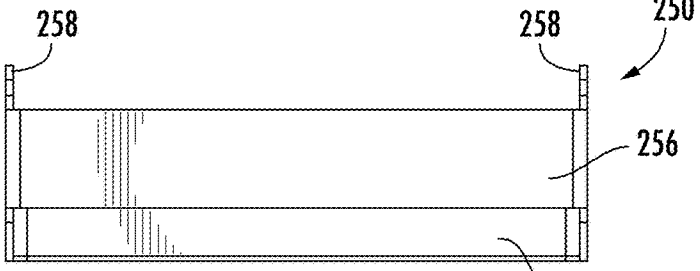
Figure 16A:
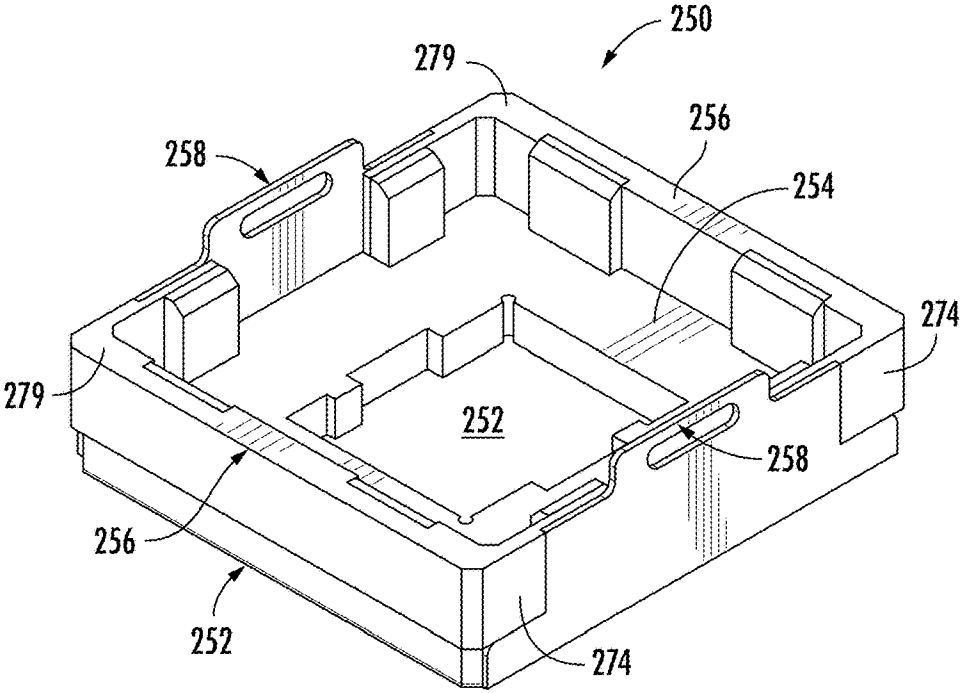

Having thus described some example embodiments in general terms, reference will now be made to the accompanying drawings, which are not necessarily drawn to scale, and wherein:

FIG. 1 is a perspective view of an equipment case in accordance with an embodiment of the present invention;

FIG. 2 is a perspective view of the equipment case of FIG. 1 wherein the case lid is pivoted to an open position relative to the case body;

FIG. 3 is a partially exploded perspective view of the equipment case of FIG. 2;

FIG. 4 is a perspective view of the equipment case of FIG. 2, wherein a protective layer coupled with an interior surface of the lid comprises a removable portion that has been removed and disposed in an interior volume defined in a tray that is disposed in the base;

FIG. 5 is a perspective view of the equipment case of FIG. 2, wherein the tray and the removable portion have been removed;

FIG. 6 is a perspective view of the equipment case of FIG. 2, wherein the removable portion has been removed from the protective layer in the lid and a router is inserted in a bottom wall of the tray;

FIG. 7 is a perspective view of the equipment case of FIG. 2, wherein a 1U server is disposed in the tray and is resting on the removable portion from the protective layer in the lid;

FIGS. 8A-8B are respective top plan and side elevation views of a protective layer in accordance with an embodiment of the present invention;

FIGS. 9A-9C are respective perspective, side elevation, and top plan views of another protective layer in accordance with an embodiment of the present invention;

FIGS. 10A-10B are respective top plan and side elevation views of a removable portion of the protective layer of FIGS. 9A-9C in accordance with an embodiment of the present invention;

FIGS. 11-15B are various views of components of yet another protective layer in accordance with an embodiment of the present invention; and FIGS. 16A-16C are respective perspective, top plan, and side elevation views of a protective layer assembled from the components of FIGS. 11-15B in accordance with an embodiment of the present invention.

Repeat use of reference characters in the present specification and drawings is intended to represent same or analogous features or elements of embodiments of the present invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, terms referring to a direction or a position relative to the orientation of a case, container, or components thereof, such as but not limited to "vertical," "horizontal," "upper," "lower," "front," or "rear," refer to directions and relative positions with respect to the case's, container's, or component's orientation in its normal intended operation, as indicated in the Figures herein. Thus, for instance, the terms "vertical" and "upper" refer to the vertical direction and relative upper position in the perspectives of the Figures and should be understood in that context, even with respect to an apparatus that may be disposed in a different orientation. The term "substantially," as used herein, should be interpreted as "nearly" or "close to", such as to account for design and manufacturing tolerances of the apparatus.

Moreover, the term "or" as used in this application and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may. The phrase "at least one of A and B" is satisfied by any of A alone, B alone, A and B alone, and A and B with others. The phrase "one of A and B" is satisfied by A, whether or not also in the presence of B, and by B, whether or not also in the presence of A.

Embodiments of the present invention relate to improved equipment cases and methods of using such equipment cases. In various embodiments, an equipment case can include a foam stack for protecting various types of equipment, including but not limited to electronics equipment, computing devices, and the like. In one embodiment, the foam stack is configured to protect multiple sizes of computer servers. For instance, the foam stack can include a first layer that has internal dimensions that are selectively modifiable to accommodate different rack unit servers by removing a portion of a second layer and inserting it in the first layer.

Although one or more preferred embodiments are discussed herein in the context of computer servers and other computer equipment and peripherals, those of skill in the art will appreciate that the present invention is not so limited. In particular, it is contemplated that embodiments of the present invention may be used with any suitable equipment that needs or requires protection and support during storage or transport. Additional aspects of embodiments of the present invention are described in greater detail below.

Referring first to FIGS. 1-4, in one embodiment an equipment case 100 comprises a lid 102 and a base 104. Lid 102 and base 104 are connectable to one another, e.g., via hinges. Thus, lid 102 may be pivotably connected with base 104. Together, lid 102 and base 104 define an interior volume 105 within case 100. Case 100 also can comprise two or more wheels 106 and a retractable handle 108. Lid 102 is moveable between a closed position relative to base 104 (FIG. 1) and an open position relative to base 104 (FIGS. 2-7). Lid 102 defines a peripheral mating surface 107 that engages a peripheral mating surface 109 of base 104 when lid 102 is in the closed position relative to the base 104.

In the illustrated embodiment, case 100 comprises a protective layer system including a plurality of protective layers. Although any number of layers may be used in various embodiments, here case 100 includes a first protective layer 110, a second protective layer 112, and a third protective layer 114. As described in more detail below, first protective layer 110 can resemble a basket or tray in some embodiments and is removably disposed within interior volume 105 defined in case 100. In various embodiments, first protective layer 110 is disposed at least partially within base 104.

Second protective layer 112 in this embodiment is coupled with an interior surface of lid 102 and is recessed within lid 102 relative to first peripheral mating surface 107. Second protective layer 112 also comprises a removable portion 116 that is selectively removable from protective layer 112 and that can be replaced with respect thereto in a correspondingly-shaped recess 117 (FIG. 4). As shown in FIG. 4, for example, removable portion 116 of second protective layer 112 preferably is dimensioned such that, when it is removed from second protective layer 112, it can be placed into (e.g., snugly received in) first protective layer 110. Also, after removeable portion 116 is removed, second protective layer 112 defines one or more remaining portions 118. In this embodiment, third protective layer 114 is disposed within base 104 and is located beneath first protective layer 110.

In one example of use, and referring now also to FIGS. 5-7, the protective layer system of case 100 is configurable to store and/or transport multiple different types and sizes of electronics equipment. For instance, in the illustrated embodiment, third protective layer 114 defines a recess 120 sized to receive (e.g., snugly retain via a press fit, interference fit, or friction fit) at least one computing device 122 therein. As best seen in FIG. 5, in which first protective layer 110 has been removed from case 100, the computing device 122 can be, for example, a laptop computer. In some embodiments, computing device 122 is flush with or lower than third protective layer 114 when disposed in recess 120. In some embodiments, third protective layer 114 can be removably disposed within base 104 so that other equipment, such as computer peripherals, can be disposed beneath third protective layer 114.

Next, first protective layer 110 comprises a bottom wall 124 and a plurality of side walls 126 that are coupled with bottom wall 124. In this embodiment, first protective layer 110 is rectangular or square when viewed in plan and comprises four side walls 126, though that is not required in all embodiments. Here, side walls 126 extend perpendicularly to bottom wall 124. In certain embodiments, first protective layer 110 comprises at least one handle 127 formed, e.g., from a suitable lightweight material such as HDPE or the like. In the illustrated embodiment, two laterally opposing handles 127 are shown and may be coupled to or integral with respective side walls 126.

When first protective layer 110 is disposed in case 100, bottom wall 124 is disposed below second peripheral mating surface 109 in base 104, while the plurality of side walls 126 extend above second peripheral mating surface 109. Second protective layer 112 may be recessed relative to first peripheral mating surface 107 such that, when lid 102 is closed relative to base 104, the plurality of side walls extend into lid 102 and may engage second protective layer 112. Movement of first protective layer 110 during storage or transport is thereby constrained by both lid 102 and base 104 when lid 102 is closed. Further, as shown, second protective layer 112 can define at least one slot 129 between second protective layer 112 and lid 102 to receive all or portions of first protective layer 110 when lid 102 is closed. For example, in the illustrated embodiment, two slots 129 are provided and dimensioned to respectively receive handles 127 when lid 102 is closed. This provides further stability and support to first protective layer 110 and further restrains its movement in various embodiments.

Bottom wall 124 also defines a recess 128 in this embodiment sized to receive (e.g., snugly retain via a press fit, interference fit, or friction fit) at least one computing device 130 therein. As best seen in FIG. 6, the computing device 130 can be, for example, a network switch. In some embodiments, computing device 130 is flush with or lower than bottom wall 124 when placed in recess 128. Further, the bottom wall 124 and side walls 126 define a first interior volume 132 (FIG. 3). In various embodiments, first interior volume 132 is dimensioned to receive a computing device, such as a computer server.

Also, when removable portion 116 is removed from second protective layer 112 and placed in first interior volume 132, the removable portion and side walls 126 together define a second interior volume 134 (FIG. 4). Second interior volume 134 also preferably is dimensioned to receive a computing device, such as a computer server, but of different size than the computing device intended to be received in first interior volume 132. As shown in FIG. 7, for example, a computing device 136 is received in second interior volume 134.

In various embodiments, second interior volume 134 is smaller than first interior volume 132. In certain embodiments, second interior volume 134 is about one half of the volume of first interior volume 132. In certain embodiments, the depth dimension of first interior volume 132 is about 3.5", and the depth dimension of second interior volume 134 is about 1.75" (e.g., the height or depth of removable portion 116 is about 1.75" in one embodiment). In one embodiment, first interior volume 132 is dimensioned to receive a 2 "rack unit" or "2U" server, and second interior volume 134 is dimensioned to receive a 1 rack unit server ("1U" server). Also, in one embodiment, recess 120 defines an interior volume that is smaller than either of first interior volume 132 or second interior volume 134, and recess 128 defines an interior volume that is smaller than the interior volume of recess 120. Those of skill in the art will appreciate, however, that the relative and absolute dimensions of recess 120, recess 128, first interior volume 132, and second interior volume 134 can and will vary in various embodiments according to the specific equipment used with case 100, the size of case 100, and the user's needs or requirements, among other things.

Preferably, the relative dimensions of first, second, and third protective layers 110, 112, and 114 within interior volume 105 are such that the second protective layer 112, or at least a remaining portion 118 thereof, engages at least a portion of first protective layer 110 when lid 102 is moved into the closed position relative to base 104. In some embodiments, when lid 102 is moved into the closed position relative to base 104, second protective layer 112, or at least a portion thereof, alternatively or in addition engages and/or supports any computing device (e.g., computing device 136) located in either first interior volume 132 or second interior volume 134. In other words, for example, when a 2U server is placed in first interior volume 132, second protective layer 112 can engage and/or support that computing device when lid 102 is closed in some embodiments. When removable portion 116 is removed from second protective layer 112 and placed in first interior volume 132, and when a 1U server is placed in second interior volume 134, the remaining portion(s) 118 of second protective layer 112 likewise can engage and/or support that computing device when lid 102 is closed.

Thus, if the user of the case 100 desires to store or transport a 2U server, the user can place the 2U server in first interior volume 132 and does not need to remove removable portion 116 from second protective layer 112 (or can replace it in recess 117). If the user desires to store or transport a 1U server instead of a 2U server, the user can remove removable portion 116 from second protective layer 112 and place it in first interior volume 132 of first protective layer 110. When the lid 102 is closed, at least part of second protective layer 112 engages and/or supports the particular computing device in first protective layer 110 regardless of whether removable portion 116 has been removed from second protective layer 112.

In one embodiment, lid 102 and/or base 104 preferably are formed from a suitable lightweight polymeric material (e.g., polypropylene or a blend thereof), though any suitable material can be used in various embodiments. In some embodiments, lid 102 and/or base 104 are formed by rotational molding of a suitable lightweight resin. Further, in various embodiments, all or portions of protective layers 110, 112, and 114 can be formed from foam or another suitably compliant protective or cushioning material. In some embodiments, all or portions of protective layers 110, 112, and 114 are formed of cross-linked polyethylene foam having a density between about 2 and 4 pounds per cubic foot, although other materials (such as polyester foam) and/or densities can be used in other embodiments. In various embodiments, the components of protective layers 112 and 114 can be bonded to case 100, as needed or required, using a suitable adhesive, such as a hot melt adhesive or a spray adhesive.

Case 100 can be any suitable size in various embodiments, but in some embodiments case 100 can be sized and configured to comply with rules or regulations regarding airline travel and, more particularly, regarding size and/or weight requirements for checked baggage. For example, case 100 preferably weighs about 15-25 lbs. when empty (i.e., including its plurality of protective layers 110, 112, 114 but not including any equipment). When loaded with the example equipment described above, case 100 preferably weighs less than the maximum check-in weight of 66 lbs. (e.g., between about 55 and 60 lbs.). Further, case 100 can be sized to correspond to the maximum allowable size for checked baggage in air travel (e.g., less than or equal to 62 linear inches in length+width+height).

Next, FIGS. 8A-16C illustrate various components of a protective layer system in accordance with an embodiment of the present invention. In this regard, FIGS. 8A-8B are respective top plan and side elevation views of a protective layer 200 configured to be received in base 104 of case 100 and is analogous in some respects to third protective layer 114, described above. Protective layer 200 in this embodiment comprises a sheet of material that defines a periphery 202 shaped to correspond to the interior of base 104 of case 100. Periphery 202 can include one or more notches 204 that accommodate internal protrusions in case 100 (e.g., due to the presence of handles, wheels, latches, or other features of case 100), for example, and/or one or more notches 206 that are sized to receive foam block(s) 208 (FIG. 5) that serve as spacers between an internal surface of case 100 and protective layer 200. As with protective layer 114 above, protective layer 200 defines a recess or opening 210, which can but need not extend entirely through protective layer 200, that is dimensioned to receive at least one computing device, such as a laptop. As those of skill in the art will appreciate, the size, shape, and location of recess 210 within protective layer 200 will vary based on the type of equipment intended to be used in case 100. Additionally, more than one recess 210 may be provided in various embodiments. Further, in this embodiment protective layer 200 comprises a top surface 212 and an opposite bottom surface 214. One or more longitudinal protrusion(s) 216 can extend from bottom surface 214 and can rest against a bottom surface of base 104 of case 100. Thus, protrusion(s) 216 serve to space protective layer 200 apart therefrom. This can allow additional peripherals or other equipment to be stored beneath protective layer 200.

FIGS. 9A-9C are respective perspective, side elevation, and top plan views of a protective layer 220. Protective layer 220 is configured to be received in lid 102 of case 100 and thus is analogous in some respects to second protective layer 112 described above. FIGS. 10A-10B are respective top plan and side elevation views of a removable portion 222 of protective layer 220. Protective layer 220 comprises a sheet of material that defines a periphery 224 shaped to correspond to an interior surface of lid 102 of case 100, a top surface 226, and an opposite bottom surface 228. Bottom surface 228 and/or periphery 224 can be coupled with an interior surface of lid 102, and top surface 226 can face outward from lid 102. Top surface 226 defines at least one recess 230 dimensioned to receive (e.g., snugly retain via a press fit, interference fit, or friction fit) at least one removable portion 222. In this embodiment, a single recess 230 is provided resembling a rounded square or rectangle in shape and that surrounds a central portion 232 of protective layer 220, though in other embodiments recess 230 can have any shape and need not be centrally located or surround central portion 232. Recess 230 does not extend entirely through protective layer 220 in this embodiment. It will be appreciated that the depth of recess 230 can depend on the desired depth of removable portion 222, which may itself depend on the type of equipment to be used in case 100. Further, similar to second protective layer 112 above, in this embodiment protective layer 220 defines a pair of notches 234 in periphery 224 that, together with the interior of lid 102, define slots that are dimensioned to accommodate handles of another protective layer in case 100 when lid 102 is closed. Of course, the slots can be located entirely within protective layer 220 in other embodiments. Finally, periphery 224 also can define one or more slots 236 to accommodate a lid support hinge 238 (FIGS. 5-7), if provided.

Removable portion 222 also comprises a sheet of material that defines a top surface 240 that can be flush with top surface 226 when removable portion 222 is coupled with protective layer 220 and a bottom surface 242 that is opposite top surface 240. Removable portion 222 also defines a periphery 244 whose dimensions generally correspond to the internal dimensions of recess 230 so that removable portion 222 can be easily removed from but also snugly retained, e.g., via a press fit, interference fit, or friction fit, therein. As explained above, the dimensions of periphery 244 also preferably correspond to the inner dimensions of an interior volume (e.g., first interior volume 132 described above) of another protective layer in case 100. Periphery 244 can define or more notches 246 that can serve, e.g., as access points that allow a user to grasp removable portion 222 to remove it from and replace it in protective layer 220. Removable portion 222 also defines a recess 248 that in this embodiment extends through removable portion 222 and that is dimensioned to receive central portion 232 of protective layer 220.

Next, FIGS. 11-15B are various views of components of a protective layer 250 in accordance with an embodiment of the present invention, and FIGS. 16A-16C are respective perspective, top plan, and side elevation views of protective layer 250 in assembled form. Protective layer 250 is configured to be removably disposed within case 100, for example disposed on or above protective layer 200, and protective layer 250 is analogous in some respects to first protective layer 110 described above.

Although protective layer 250 can be constructed in a variety of ways in various embodiments, in this embodiment, protective layer 250 comprises a lower base layer 252, upper base layer 254, a pair of U-shaped sidewalls 256, a pair of handles 258, and a plurality of blocks 260. Here, lower base layer 252 comprises a flat, solid sheet of material. Upper base layer 254 has the same, or about the same, peripheral dimensions as lower base layer 252 in this embodiment, and upper base layer 254 defines a plurality of recesses 262. Recesses 262, which can be of various sizes as needed or desired, are dimensioned to receive lower portions 264 of blocks 260 therein. Recesses 262 can be disposed about the internal periphery of upper base layer 254, for example as shown with two recesses 262 on each of four sides, although any suitable configuration could be used. Upper base layer also defines a recess or opening 266 sized to receive at least one computing device therein. Recess 266 is centrally located in this embodiment and generally rectangular in shape, with an internal peripheral edge 268 that defines a plurality of notches 270 so that the at least one computing device can be easily removed from but also snugly retained, e.g., via a press fit, interference fit, or friction fit, therein. Of course, more than one recess 266 may be provided in other embodiments, and recess 266 likewise can be defined in other locations in upper base layer 254. Recesses 262 and 266 extend through upper base layer 254 in this embodiment.

The U-shaped sidewalls 256 each comprise a longitudinal body portion 272 dimensioned to extend along one of two opposite sides of upper base layer 254. Each sidewall 256 also includes a pair of arms 274, with each arm 274 extending perpendicularly from opposite ends of each body portion 272. Thus, when body portions 272 are positioned on opposite sides of upper base layer 254, the arms 274 extend along the adjacent sides of upper base layer 254. Body portions 272 can also define notches 276 sized to fit around respective blocks 260 that are disposed in selected recesses 262. Further, each arm 274 can define a notch 278 configured to receive one side of a handle 258. Finally, each sidewall 256 defines an upper surface 279 extending along each body portion 272 and arm 274. In one embodiment, when lid 102 is in a closed position relative to base 104, protective layer 220 engages upper surface 279.

Handles 258 comprise a body portion 280. A grip 282 extends upward from an upper side of body portion 280. Body portion 280 also defines a pair of shoulders 284 that extends laterally outward from a lower side of body portion 280.

To assemble protective layer 250, upper base layer 254 is first stacked on lower base layer 252 and these components can be bonded together, for example using a suitable adhesive as noted above. Next, blocks 260 are positioned in recesses 262 and bonded together with upper base layer 254. A first sidewall 256 is then positioned on one side of upper base layer 254 radially outward of blocks 260 such that the blocks 260 on the same side as body portion 272 are disposed in notches 276 and a block 260 on each adjacent side is disposed just radially inward of each arm 274. That sidewall 256 can be bonded to upper base layer 254 and to each block 260, and then another sidewall 256 can be attached in a similar fashion with its body portion 272 positioned opposite the body portion 272 of the first sidewall. In some embodiments, part of the body portions 272 and arms 256 of sidewalls 256 may extend slightly radially outward of the peripheral edges of upper base layer 254. Finally, handles 258 can be attached on the sides of upper base layer 254 along which arms 274 extend. For example, on each such side of upper base layer 254, each body portion 280 of a handle 258 can be disposed in the notches 278 defined in the arms 274 that extend along that side of upper base layer 254. The body portion 280 is then bonded to the arms 274 at this location. Also, with body portions 280 in that position, each shoulder 284 is disposed beneath each arm 274 and facing lower base layer 252. As a result, the lower side of each body portion 280 and each shoulder 284 can be bonded to lower base layer 252.

As discussed above, when fully assembled, protective layer 250 can resemble a tray or basket with handles in this embodiment that defines a first interior volume when removable portion 222 is not included and that defines a second, smaller interior volume (e.g., about one-half the size of the first interior volume) when removable portion 222 is included. In other embodiments, however, protective layer 250 can have any other suitable configuration. For example, only one handle 258 may be provided, or four such handles 258 could be provided. Likewise, sidewalls 256 need not be U-shaped in all embodiments. Blocks 260 within protective layer 250 can serve to retain a computing device and/or removable portion 222 within the interior volume and can also serve as spacers to provide space between sidewalls 256 and either the computing device or the removable portion 222.

Based on the foregoing, it will be appreciated that embodiments of the invention provide improved equipment cases, protective layer systems, and methods of using equipment cases. Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. An equipment case, comprising:

a lid pivotably connected with a base;

a plurality of protective layers disposed within the equipment case, the plurality of protective layers comprising:

a first protective layer comprising a bottom wall and a plurality of side walls, the bottom wall and plurality of side walls defining a first interior volume, the first protective layer disposed at least partially within the base; and a second protective layer coupled with an interior surface of the lid, the second protective layer comprising at least one removable portion, the at least one removable portion dimensioned to fit within the first interior volume;

wherein, when the at least one removable portion is disposed within the first interior volume, the at least one removable portion and the plurality of side walls together define a second interior volume that is smaller than the first interior volume;

wherein the first interior volume is dimensioned to receive a first computing device having a first size, and wherein the second interior volume is dimensioned to receive a second computing device having a second size smaller than the first size;

wherein the lid defines a first peripheral mating surface that engages a second peripheral mating surface of the base when the lid is in a closed position relative to the base, and wherein the bottom wall of the first protective layer is disposed below the second peripheral mating surface and the plurality of side walls extend above the second peripheral mating surface; and wherein the first protective layer comprises at least one handle formed from a plastic material, wherein at least one slot is defined between the second protective layer and the interior surface of the lid, and wherein the at least one handle is received in the at least one slot when the lid is in a closed position relative to the base.

2. The equipment case of claim 1, wherein either or both of the first and second protective layers are formed from a foam material.

3. The equipment case of claim 2, wherein the foam material comprises polyethylene.

4. The equipment case of claim 1, wherein the first computing device and the second computing device are servers.

5. The equipment case of claim 1, wherein the second protective layer is recessed within the lid relative to the first peripheral mating surface.

6. The equipment case of claim 5, wherein at least part of the second protective layer engages at least part of the first protective layer when the lid is in a closed position relative to the base.

7. The equipment case of claim 1, wherein, when the lid is in a closed position relative to the base, at least part of the second protective layer is configured to engage a computing device disposed in the first protective layer regardless of whether the at least one removable portion has been removed from the second protective layer.

8. A method of using an equipment case, the method comprising:

providing an equipment case comprising:

a lid pivotably connected with a base;

a first protective layer within the base, the first protective layer comprising a bottom wall and a plurality of side walls, the bottom wall and plurality of side walls defining a first interior volume corresponding to the size of a first server;

a second protective layer coupled with an interior surface of the lid, the second protective layer defining a recess in which at least one removable portion is disposed;

removing the at least one removable portion and placing it within the first interior volume such that the at least one removable portion and plurality of side walls define a second interior volume corresponding to the size of a second server;

placing the second server in the second interior volume; and moving the lid from an open position to a closed position relative to the base;

wherein the equipment case further comprises a third protective layer disposed in the base beneath the first protective layer, the method further comprising placing a computer in the third protective layer.

9. The method of claim 8, further comprising moving the lid from the closed position to the open position relative to the base, removing the second server from the second interior volume, removing the at least one removable portion from the second interior volume, replacing the at least one removable portion in the second protective layer, disposing the first server in the first interior volume, and moving the lid from the open position to the closed position relative to the base.

10. The method of claim 9, wherein the second protective layer engages the first server and the second server when the lid is in the closed position relative to the base.

11. An equipment case, comprising:

a lid and a base, wherein the lid and base are connectable to one another to define an interior volume;

a foam stack disposed within the interior volume, the foam stack comprising:

a first layer of foam coupled with the base, the first layer of foam defining a first opening sized to receive a first computing device;

a tray that is removably disposed above the first layer, wherein a bottom wall of the tray defines a second opening sized to receive a second computing device, wherein the tray comprises a plurality of side walls that, together with the bottom wall, define a third opening sized to receive a third computing device; and a second layer of foam coupled with an interior surface of the lid, the second layer of foam comprising a removable portion sized to fit within the plurality of side walls in the tray.

12. The equipment case of claim 11, wherein, when the removable portion is disposed within the third opening of the tray, the removable portion and plurality of side walls define a fourth opening sized to receive a fourth computing device.

13. The equipment case of claim 12, wherein the third computing device is a 2U server and the fourth computing device is a 1U server.

14. The equipment case of claim 12, wherein the fourth opening defines an interior volume that is about half of the interior volume defined by the third opening.

15. The equipment case of claim 14, wherein the first opening defines an interior volume that is smaller than the interior volumes defined by the third and fourth openings, and wherein the second opening defines an interior volume that is smaller than the interior volume defined by the first opening.

16. The equipment case of claim 11, wherein the bottom wall of the tray is disposed within the base and wherein the plurality of side walls extend into the lid when the lid is in a closed position relative to the base.

17. The equipment case of claim 11, wherein the lid and base are formed from a rotomolded resin material.

* * * * *